US006675787B2

(12) United States Patent
Damitz et al.

(10) Patent No.: US 6,675,787 B2
(45) Date of Patent: Jan. 13, 2004

(54) METHOD AND DEVICE FOR CONTROLLING AN INTERNAL COMBUSTION ENGINE

(75) Inventors: Jens Damitz, Illingen (DE); Dirk Samuelsen, Ludwigsburg (DE); Ruediger Fehrmann, Leonberg (DE); Matthias Schueler, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/028,967

(22) Filed: Dec. 17, 2001

(65) Prior Publication Data

US 2002/0096157 A1 Jul. 25, 2002

(30) Foreign Application Priority Data

Dec. 16, 2000 (DE) ..... 100 62 895

(51) Int. Cl.[7] ..... F02D 41/00
(52) U.S. Cl. ..... 123/673; 123/676; 701/109
(58) Field of Search ..... 123/673, 676; 701/109

(56) References Cited

U.S. PATENT DOCUMENTS 5,131,371 A * 7/1992 Wahl et al. ..... 123/676
5,353,636 A 10/1994 Sakurai et al.
5,813,389 A * 9/1998 Kitamura et al. ..... 123/673
6,276,349 B1 * 8/2001 Kofler et al. ..... 123/673
6,314,952 B1 * 11/2001 Turin et al. ..... 123/673
6,382,198 B1 * 5/2002 Smith et al. ..... 123/673

FOREIGN PATENT DOCUMENTS

| | | |
|---|---|---|
| DE | 197 27 218 | 6/1996 |
| DE | 197 33 958 | 2/1999 |
| DE | 197 34 072 | 2/1999 |
| DE | 199 03 721 | 7/2000 |
| EP | 0 643 212 | 3/1995 |

* cited by examiner

*Primary Examiner*—Erick Solis
(74) *Attorney, Agent, or Firm*—Kenyon & Kenyon

(57) ABSTRACT

A device and a method are described for controlling an internal combustion engine, in which a control deviation and a governor are allocated to each cylinder of the internal combustion engine, each governor preselecting a cylinder-specific triggering signal on the basis of the allocated control deviation. Cylinder-specific actual values are ascertained on the basis of a signal from a sensor arranged in the exhaust train and are compared to a setpoint value. Triggering signals for the cylinder-individual control of the fuel quantity and/or air quantity are preselected on the basis of the comparison.

7 Claims, 3 Drawing Sheets

METHOD AND DEVICE FOR CONTROLLING AN INTERNAL COMBUSTION ENGINE

FIELD OF THE INVENTION

The present invention relates to a method and a device for controlling an internal combustion engine.

BACKGROUND INFORMATION

Such a method and such a device for controlling an internal combustion engine are known, for example, from the German Published Patent Application No. 195 27 218. There, a method and a device are described for regulating the smooth running of an internal combustion engine, in which a control deviation and a governor are allocated to each cylinder of the internal combustion engine. Each governor stipulates a cylinder-specific triggering signal on the basis of the allocated control deviation.

The aim of this procedure is to equalize the fuel quantity metered to the individual cylinders. Differences in the metered fuel quantity between the individual cylinders are equalized. In this context, it may occur that although the same fuel quantity is metered to all the cylinders and/or all the cylinders contribute the same torque to the total torque, the individual cylinders receive different air quantities metered in. The result is that increased exhaust-gas emissions, particularly particle emissions, occur at individual cylinders. When working with the related art, these increased emissions can only be decreased by reducing the total injection quantity and/or the average value of the cylinder-individual fuel quantities to the extent that the emissions are minimized. This quantity reduction leads to a decrease in the performance of the internal combustion engine.

SUMMARY OF THE INVENTION

Because cylinder-specific actual values are determined on the basis of a signal from a sensor arranged in the exhaust train and are compared to a setpoint value, and because triggering signals for the cylinder-individual control of the fuel quantity and/or air quantity are specifiable on the basis of the comparison, the exhaust-gas emissions can be markedly reduced, the power output of the internal combustion engine not being impaired.

Preferably, sensors are used which provide a signal that characterizes the oxygen concentration in the exhaust gas, or a signal which characterizes the pressure in the exhaust gas.

The lambda values, i.e. the oxygen concentrations, of all cylinders are preferably equalized. In this context, both the injected fuel quantity and the supplied air quantity, which is adjustable, for example, with the aid of a cylinder-individual exhaust-gas recirculation, are used as a manipulated variable. In the following, the procedure is described using the fuel quantity as an example.

It is particularly advantageous if the procedure is combined with a smooth-running control according to the related art.

According to the present invention, it was recognized that a particularly simple signal conditioning lies in the fact that the signal of the sensor arranged in the exhaust train is able to be filtered using at least two filtering elements having different frequencies; at least two frequency-specific actual values, a setpoint value and frequency-specific control deviations are determinable on the basis of the filtered signal.

A particularly meaningful signal is yielded if, to make the frequency-specific quantities available, the output signal of the sensor arranged in the exhaust train is able to be filtered by at least two band-pass filters with adjustable mid-frequencies, the mid-frequencies lying at integral multiples of the camshaft frequency.

Furthermore, of particular importance are the implementations in the form of a computer program having a program-code element, and in the form of a computer program product having the program-code element. The computer program of the present invention has the program-code element for carrying out all the steps of the method according to the present invention when the program is executed on a computer, particularly a control unit for an internal combustion engine of a motor vehicle. Thus, in this case the present invention is implemented by a program stored in the control unit, so that this control unit provided with the program represents the present invention in the same way as the method for whose accomplishment the program is suitable. The computer program product of the present invention has the program-code element which is stored on a machine-readable data carrier in order to carry out the method of the present invention when the program product is executed on a computer, particularly a control unit for an internal combustion engine of a motor vehicle. Thus, in this case the present invention is implemented by a data carrier, so that the method of the present invention can be carried out when the program product, i.e. the data carrier is integrated into a control unit for an internal combustion engine, particularly of a motor vehicle. In particular, an electrical storage medium, e.g. a read-only-memory (ROM), an EPROM or even an electrical permanent storage such as a CD-ROM or DVD may be used as data carrier or as computer program product.

DETAILED DESCRIPTION

In the following, the procedure of the present invention is explained using a self-ignition internal combustion engine having exhaust-gas turbocharger and 4 cylinders as an example. However, the present invention is not limited to self-ignition internal combustion engines. It can also be used for other types of internal combustion engines. In this case, corresponding components can be exchanged. In particular, the present invention can also be used for internal combustion engines having a different number of cylinders and/or for internal combustion engines without an exhaust-gas turbocharger.

Figure 1:
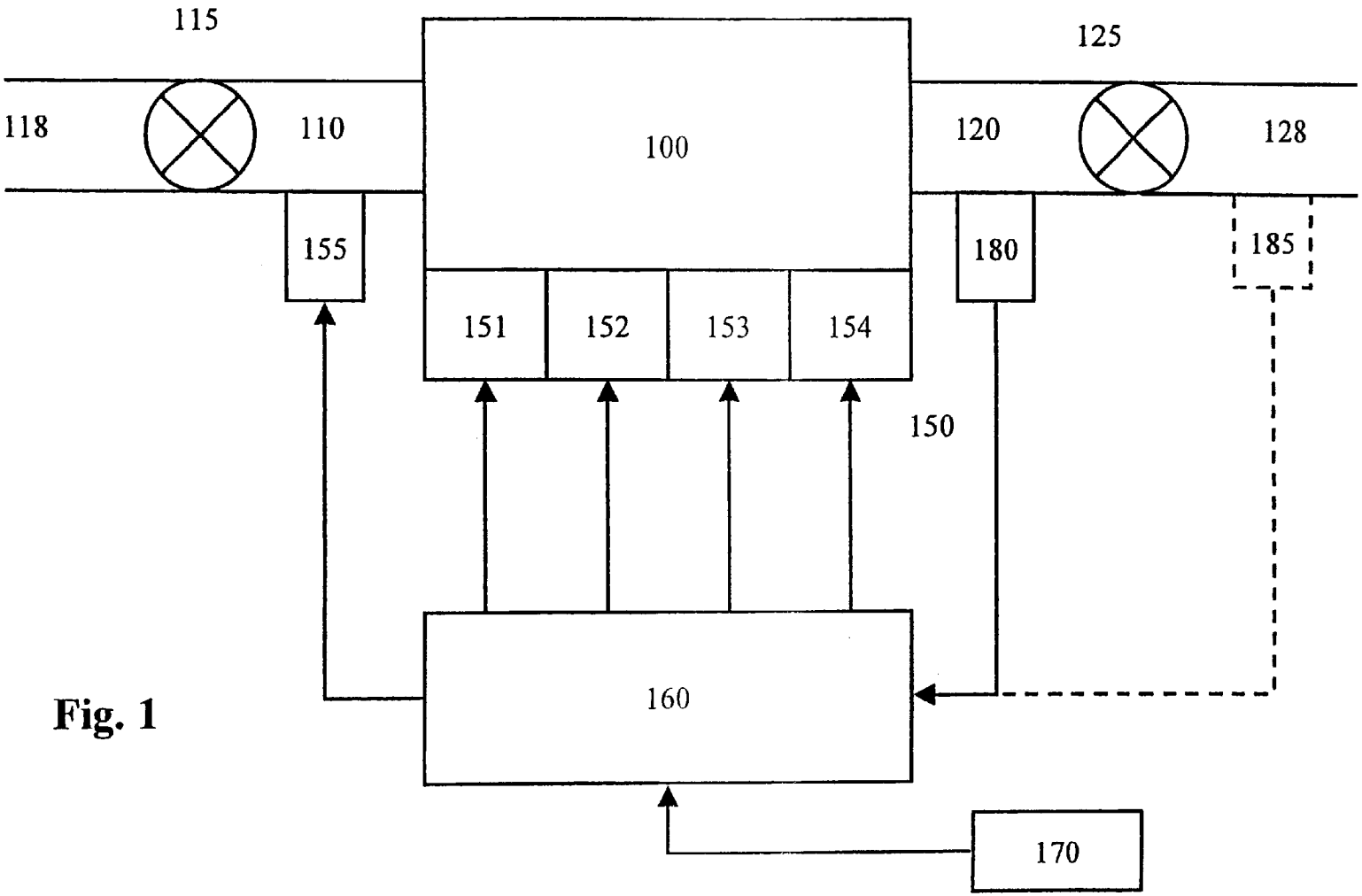
FIG. 1 shows a block diagram of the device according to the present invention.

The internal combustion engine is indicated in FIG. 1 by 100. It is supplied with air via a fresh-air line 118, an air compressor 115 and an intake line 110. The exhaust gases of the internal combustion engine arrive in an exhaust pipe 128 via an exhaust line 120 and a turbine 125. Turbine 125 drives air compressor 115 via a shaft (not shown).

Allocated to the internal combustion engine is a quantity-determining regulating device 150. Fuel is supplied via it to the internal combustion engine. In this context, an individual fuel quantity can be metered to each cylinder. This is shown in FIG. 1, in that a quantity-determining control element 151 through 154 is allocated to each cylinder. Individual control elements 151 through 154 receive triggering signals from a control unit 160. For example, control elements 151 through 154 are solenoid valves or piezo actuators which control the metering of fuel into the respective cylinder. Provision may be made per cylinder for an injector, a distributor pump or another element determining the fuel quantity injected, which meters fuel to the cylinders in turn.

Control unit 160 also acts upon a further control element 155 which influences the quantity of fresh air supplied to the internal combustion engine. In one simplified specific embodiment, this control element 155 may also be omitted. Furthermore, control unit 160 processes the output signals of various sensors 170 which characterize, for example, the ambient conditions such as temperature and pressure values, as well as the driver's command.

In addition, control unit 160 processes signals from sensors 180 which characterize the exhaust composition or the pressure and/or the temperature in the exhaust gas. This sensor is preferably situated between the internal combustion engine and turbine 125. Alternatively or additionally, sensor 185 may also be positioned downstream of the turbine in the exhaust pipe.

Sensors 180 and 185, respectively, preferably detect a signal which characterizes the oxygen concentration in the exhaust gas. Alternatively and/or additionally, the pressure in the exhaust line upstream or downstream of the turbine may also be evaluated.

This device now operates as follows. The fresh air is compressed by air compressor 115 and arrives in the internal combustion engine via intake line 110. Fuel is metered to the internal combustion engine via quantity-determining regulating device 150. In so doing, a cylinder-individual fuel quantity is supplied to each cylinder as a function of the triggering signal of control unit 160. The exhaust gases arrive at the turbine via the exhaust line, drive the turbine, and then get into the surroundings via exhaust pipe 128. Turbine 125 drives air compressor 115 via a shaft (not shown).

Control unit 160 calculates the triggering signals for acting upon control elements 151 through 154 on the basis of the various input signals, particularly the driver's command. In one preferred specific embodiment, a control device 155 is additionally provided which controls the air feed to the internal combustion engine. It may preferably be an exhaust-gas recirculation device which determines the quantity of recirculated exhaust gas. One specific embodiment in which the air quantity supplied to the individual cylinder is influenced is particularly preferred. For example, this is possible by a valve timing of the intake and discharge valves.

Figure 2:
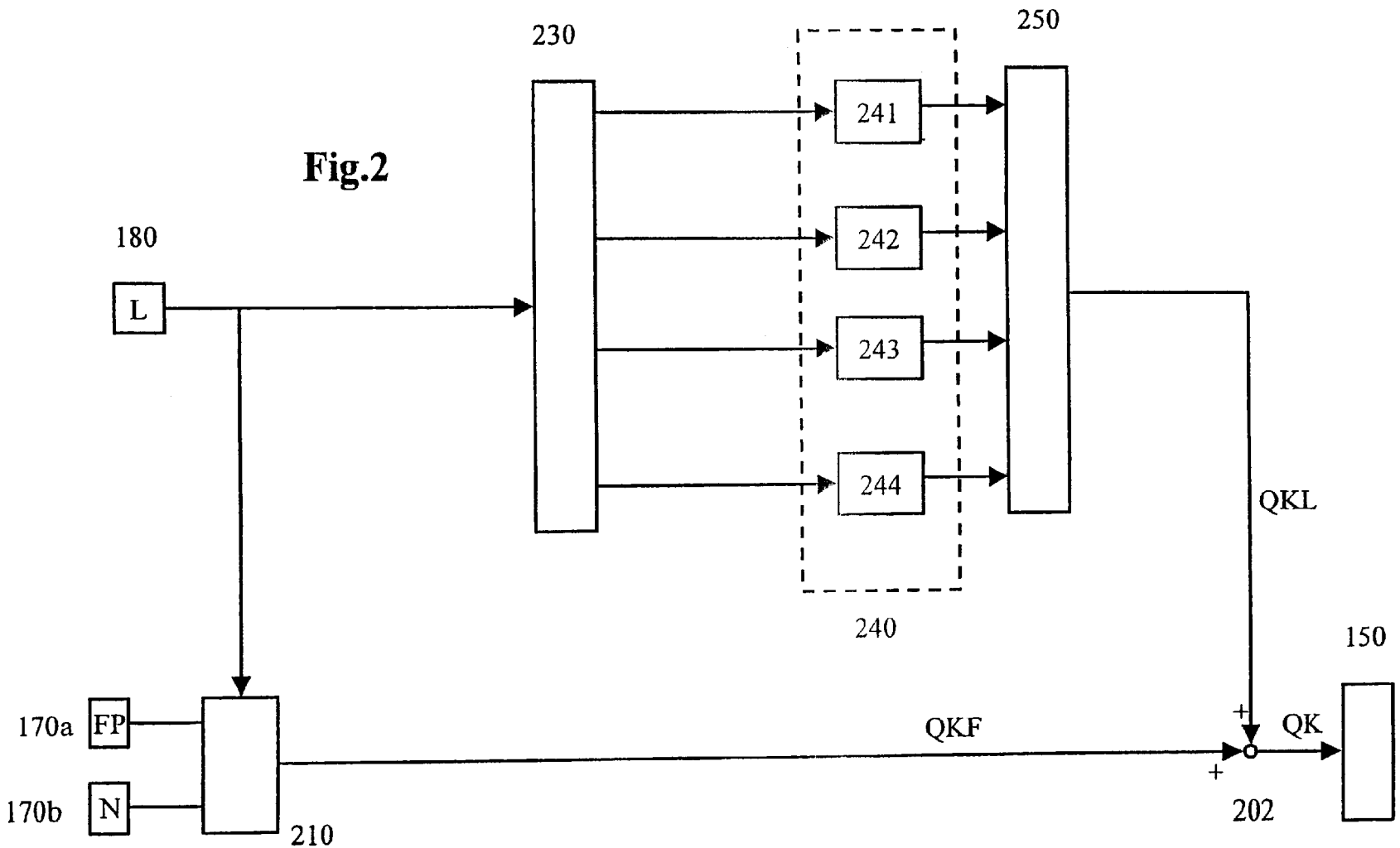
FIG. 2 shows a detailed representation.

FIG. 2 shows in detail the ascertainment of the triggering signals for control elements 151 through 155. In this case, the calculation of fuel quantity QK is shown in particular. One can proceed in a corresponding manner in calculating the air quantity.

Elements already described in FIG. 1 are designated with corresponding reference numerals. Control element 150 receives output signal QK of a summing point 202. Output signal QKF of a fuel-quantity setpoint selection 210 is applied to the first input of summing point 202. Output signal QKL of a multiplexer 250 is applied to the second input of summing point 202.

Fuel-quantity setpoint selection 210 processes the output signal from various sensors such as an accelerator-pedal position sensor 170*a* and a speed sensor 170*b*. Furthermore, provision can be made for fuel-quantity setpoint selection 210 to process output signal L of a sensor 180. Output signal L of sensor 180 corresponds to the oxygen concentration in the exhaust train.

Signal L of sensor 180 also arrives at a filtering device 230 which in turn acts upon a first governor 241, a second governor 242, a third governor 243 and a fourth governor 244 with a signal that corresponds to a control deviation. Governors 241 through 244 are designated altogether as governor 240. The individual governors in turn act upon multiplexer 250 with triggering signals which then reach summing point 202 cyclically as signal QKL.

On the basis of the various sensor signals, fuel-quantity setpoint selection 210 determines a fuel quantity QKF to be injected, which is to be supplied to the internal combustion engine. This quantity QKF corresponds to the quantity for providing the torque desired by the driver. In this context, fuel-delivery control 210 includes still further functions such as an idle-speed controller or fuel-quantity commands of further control units. Moreover, fuel-quantity setpoint selection 210 may already include a smooth-running control as is known from the related art. Furthermore, it is possible for a fuel-quantity setpoint selection that is not cylinder-individual to also take into account a lambda signal which characterizes the oxygen concentration in the exhaust gas.

Fuel-quantity setpoint selection 210 does not take into account air-quantity errors, i.e. deviations between the air quantities supplied to the individual cylinders. Different lambda values of the individual cylinders lead to fluctuations of the lambda signal. These are detected and used for the cylinder-individual control. Filtering device 230 calculates from lambda signal L, which is detected by sensor 180, a cylinder-individual control deviation between the cylinder-individual setpoint value and actual value for the lambda signal. This cylinder-individual control deviation is supplied to the respective governor allocated to the cylinder. In this context, a governor may be provided for each cylinder. Alternatively, it is also possible for one governor to process the cylinder-individual control deviations chronologically one after the other. In particular, this is the case when the present invention is implemented as a control program. Multiplexer 250 combines these signals to form a signal QKL which characterizes the deviations of the individual lambda signals from a setpoint value. This signal is formed so that in the triggering of regulating device 150, such a fuel quantity is metered that the lambda signal assumes the same value for all cylinders.

With the aid of the cylinder-individual lambda closed-loop control, air-quantity errors occurring between the individual cylinders can also be compensated for by interventions in the air metering, i.e. the exhaust gases of all cylinders have the same oxygen concentration. The exhaust-gas values of the internal combustion engine can be markedly improved compared to customary quantity-equalization controls according to the related art. This is of particular advantage at low speeds and large injected fuel quantities. Even small deviations of the lambda value, i.e. of the oxygen concentration in the exhaust gas of one cylinder in the direction of a richer mixture, lead to a sharp increase of soot emissions in this cylinder. This elevated soot emission is not offset by the somewhat lower soot formation in a cylinder with a correspondingly lean mixture. Thus, given equal engine torque, a lower smoke number can be attained using a cylinder-individual lambda closed-loop control. Alternatively, given the same smoke number, the output torque can be increased. This is based on the fact that, when working with a system without cylinder-individual lambda closed-loop control, the fuel quantity and consequently the output torque is lowered so far that the soot quantity lies below a specific value.

Particularly internal combustion engines equipped with an exhaust-gas turbocharger, i.e. an air compressor and a turbine, the demands on the conditioning of the lambda signal are particularly high, since the signal amplitude to be evaluated is very small when using a lambda probe downstream of the turbine.

Two alternatives are available for the positioning of the lambda probe. In a first alternative, the lambda probe is arranged in advance of the turbine. This offers the advantage that no mixture of the cylinder-individual exhaust-gas streams through the turbine has yet taken place. However, due to the opening of the exhaust valves, strong pressure pulsations are excited in this region. They partially offset the oscillations in the probe signal which are excited by the cylinder-individual lambda differences. This is owing to the operating mode described in the following. If a higher injected fuel quantity is injected into one cylinder, then the associated residual oxygen content in the exhaust gas, and consequently the output voltage of the lambda probe, falls. At the same time, the stronger combustion yields a higher pressure in the opening of the exhaust valve. Due to a positive cross coupling between pressure and probe signal, the pressure rise increases the sensor signal and counteracts the actual oxygen change. The measurable signal amplitude is thereby perceptibly smaller than would be expected in light of the pure oxygen oscillation. It is also disadvantageous that an additional probe is needed.

In the second alternative, the lambda probe is situated downstream of the turbine. Advantageous in this case is that the interference amplitude of the pressure pulsations in the exhaust train caused by the combustion is smaller. However, the mixture of the cylinder-individual exhaust-gas streams through the turbine has a disadvantageous effect. In this arrangement of the probe, this also reduces the amplitude of the oxygen oscillations to be measured.

Since both when using alternative 1 and in the case of alternative 2, the signal to be evaluated has a markedly lower useful amplitude than for internal combustion engines without an exhaust-gas turbocharger, an improved signal conditioning for interference suppression, particularly in the case of internal combustion engines having an exhaust-gas turbocharger, is an advantage.

The heating frequency of the lambda probe can be named as a particularly serious interference. Its interference amplitude is more or less as great as the oscillations caused by the cylinder-individual lambda differences. These oscillations can be offset by a rapid signal preprocessing.

Figure 3:
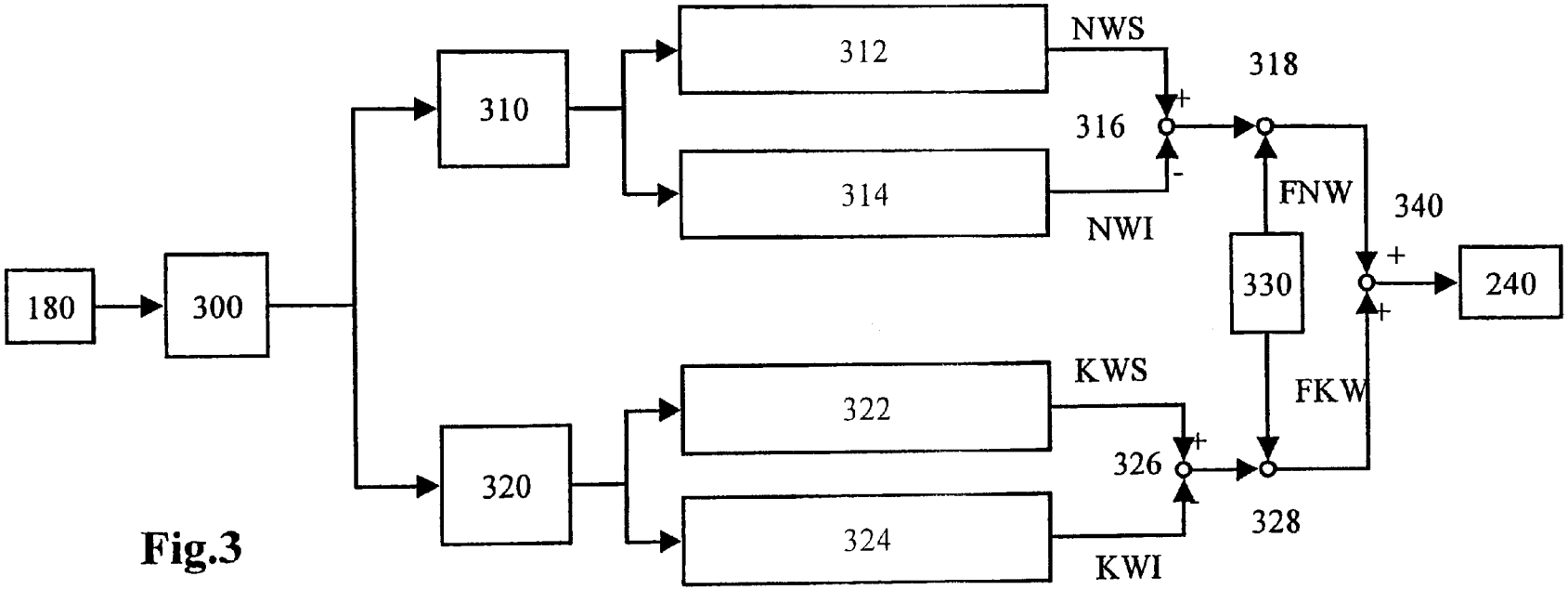
FIG. 3 shows a representation of the setpoint value formation and the actual value formation.

Control-deviation calculation 230 is shown in detail in FIG. 3. Elements already described in FIG. 2 are designated with corresponding reference numerals in FIG. 3. The output signal of sensor 180 arrives via a pre-filter 300 at a first filter 310 and a second filter 320. The output signal of first filter 310 arrives at a first setpoint-value ascertainment 312 and a first actual-value ascertainment 314. The output signal of second filter 320 reaches a second setpoint-value ascertainment 322 and a second actual-value ascertainment 324.

Output signal NWS of first setpoint-value ascertainment 312 arrives with a positive algebraic sign, and output signal NWI of first actual-value ascertainment 314 arrives with a negative algebraic sign at a node 316. In following node 318, the output signal of node 316 is combined with a weighting factor FNW. First control deviation NWL thus weighted arrives at a summing point 340, and from there at block 240.

Output signal KWS of second setpoint-value ascertainment 322 arrives with a positive algebraic sign, and output signal KWI of second actual-value ascertainment 324 arrives with a negative algebraic sign at a node 326. In following node 328, the output signal of node 326 is combined with a weighting factor FKW. Second control deviation KWL thus weighted reaches summing point 340.

Weighting factor FNW and weighting factor FKW are made available by weighting setpoint selection 330.

Available at the output of summing point 340 is control deviation L which is passed on to governor 240.

Nodes 318 and 328 are a preferred embodiment of the present invention. Alternatively, factors FNW and/or FKW can also be taken into account differently, for example, in filters 310 or 320, or not taken into account.

In the specific embodiment of an internal combustion engine having 4 cylinders shown, only two filters are provided which filter out portions of the signal having camshaft frequency and crankshaft frequency. In advantageous refinements, further frequency ranges can also be taken into account. In particular, a filter can be provided which filters out frequencies up to and including half the ignition frequency.

In the specific embodiment of an internal combustion engine having 4 cylinders shown, filters 310 and 320 are band-pass filters whose mid-frequency for filter 310 lies at the camshaft frequency, and in the case of filter 320, lies at the crankshaft frequency.

When working with other cylinder numbers, other band-pass filters can optionally be provided. Thus, for example, given an internal combustion engine having four or five cylinders, one band-pass filter having the camshaft frequency and one band-pass filter having double the camshaft frequency, which corresponds to the crankshaft frequency, can be provided.

In the case of an internal combustion engine having 2*k cylinders, k being a natural number, k band-pass filters can be provided whose mid-frequencies lie at an integral multiple of the camshaft frequency.

The output signal of sensor 180 arrives via pre-filter 300 at band-pass filters 310 and 320. This pre-filter 300 is constructed such that it filters out unwanted interferences. Pre-filter 300 is preferably constructed in such a way that it does not let through oscillations of the signal which are caused by the probe heating.

Band-pass filters 310 and 320 separate the output signal of sensor 180 into spectral components. The first, second and third actual-value ascertainment and the first, second and third setpoint-value ascertainment ascertain frequency-specific setpoint and actual values for each spectral component. The setpoint values and actual values are preferably calculated differently for the individual spectral components.

The probe signal is separated for the individual frequencies with the aid of band-pass filters 310 and 320. First actual-value ascertainment 314 and second actual-value ascertainment 324 calculate a frequency-specific actual value for each frequency. Correspondingly, provision can be made for first setpoint-value stipulation 312 and second setpoint-value stipulation 324 to calculate a frequency-specific setpoint value for each frequency. The frequency-specific control deviation is then determined in nodes 316 and 326.

It is especially advantageous if these frequency-specific control deviations are able to be weighted in a frequency-specific manner using frequency-specific weighting factors FNW and FKW. It is a particular advantage if weighting factors FNW and FKW are selected in such a way that the gain of the closed control loop is adjusted equally for all frequencies. A frequency-specific adaptation of the governor parameters can thereby be achieved.

Control deviations NWL and KWL, thus weighted or not weighted, are added up in node 340 and supplied to the governor. The governor corresponds to governor 240 shown in FIG. 2.

Particularly advantageous in this procedure is that the controllability is present even given great differences in the phase position. The frequency-specific formation of the control deviation yields an increased robustness of the governor with respect to changes of the controlled system action, e.g. by alteration in the area of the air system, particularly in the area of the intake valves, manufacturing tolerances or wear and tear.

Alternatively to the evaluation of the lambda signal, a pressure sensor can also be used which evaluates the pressure upstream or downstream of the turbine.

What is claimed is:

1. A method for controlling an internal combustion engine, comprising the steps of:

allocating a control deviation and a governor to each cylinder of the internal combustion engine, each governor preselecting a cylinder-specific triggering signal on the basis of the allocated control deviation;

ascertaining cylinder-specific actual values on the basis of a signal from a sensor arranged in an exhaust train;

performing a comparison of the ascertained cylinder-specific values to a setpoint value;

specifying triggering signals for a cylinder-individual control of at least one of a fuel quantity and an air quantity on the basis of the comparison;

causing at least two filtering elements to filter the signal of the sensor arranged in the exhaust train; and determining at least two frequency-specific actual values, a setpoint value, and frequency-specific control deviations on the basis of the filtered signal.

2. The method according to claim 1, further comprising the step of:

to provide the at least two frequency-specific actual values, causing at least two band-pass filters having adjustable mid-frequencies to filter the signal of the sensor arranged in the exhaust train.

3. The method according to claim 2, wherein:

the adjustable mid-frequencies lie at integral multiples of a camshaft frequency.

4. The method according to claim 2, wherein:

at least one of the at least two frequency-specific actual values and the setpoint value are able to be specified differently for each frequency.

5. The method according to claim 1, further comprising the step of:

weighting the allocated control deviation differently for each frequency.

6. The method according to claim 1, further comprising the step of:

causing the sensor arranged in the exhaust train to supply one of:

a signal that characterizes an oxygen concentration in an exhaust gas, and a signal that characterizes a pressure in the exhaust gas.

7. A device for controlling an internal combustion engine, comprising:

an arrangement for allocating a control deviation and a governor to each cylinder of the internal combustion engine, each governor preselecting a cylinder-specific triggering signal on the basis of the allocated control deviation;

an arrangement for ascertaining cylinder-specific actual values on the basis of a signal from a sensor arranged in an exhaust train;

an arrangement for performing a comparison of the ascertained cylinder-specific values to a setpoint value;

an arrangement for preselecting triggering signals for a cylinder-individual control of at least one of a fuel quantity and an air quantity on the basis of the comparison;

at least two filtering elements for filtering the signal of the sensor arranged in the exhaust train; and an arrangement for determining at least two frequency-specific actual values, a setpoint value, and frequency-specific control deviations on the basis of the filtered signal.

* * * * *